United States Patent [19]

Muranaka et al.

[11] Patent Number: 4,791,893

[45] Date of Patent: Dec. 20, 1988

[54] VALVE TRAIN ARRANGEMENT FOR MULTI-VALVE ENGINE

[75] Inventors: Shigeo Muranaka, Yokosuka; Shigeru Kamegaya, Tokyo; Yutaka Matayoshi, Yokosuka, all of Japan

[73] Assignee: Nissan Motor Co., Ltd., Yokohama, Japan

[21] Appl. No.: 71,242

[22] Filed: Jul. 9, 1987

[30] Foreign Application Priority Data

Jul. 11, 1986 [JP] Japan ..... 61-105726[U]

[51] Int. Cl.[4] ..... F01L 1/18; F01L 1/26

[52] U.S. Cl. ..... 123/90.4; 123/90.41; 123/90.44

[58] Field of Search ..... 123/90.4, 90.22, 90.23, 123/90.39, 90.41, 90.44

[56] References Cited

U.S. PATENT DOCUMENTS

| | | | |
|---|---|---|---|
| 2,309,291 | 1/1943 | Anderson et al. | 123/90.22 |
| 3,563,215 | 2/1971 | Ross | 123/90.44 |
| 3,563,216 | 2/1971 | Uemura | 123/90.44 |
| 3,613,647 | 10/1971 | Mettig et al. | 123/90.22 |
| 3,690,958 | 9/1972 | Thompson | 123/90.4 |
| 3,963,004 | 6/1976 | Lysinger et al. | 123/90.23 |
| 4,614,171 | 9/1986 | Malhotia | 123/90.44 |
| 4,672,927 | 6/1987 | Uchida | 123/90.44 |

FOREIGN PATENT DOCUMENTS 59-103907 6/1984 Japan .

*Primary Examiner*—Willis R. Wolfe

*Attorney, Agent, or Firm*—Foley & Lardner, Schwartz, Jeffery, Schwaab, Mack, Blumenthal & Evans

[57] ABSTRACT

A two-fingered cam follower adapted to operate two valves in unison has sliding faces which are arranged in parallel with the plane in which the cam follower swings being driven by a cam. The cam follower is pivotally mounted on a hydraulic lash adjuster which is in turn mounted on a cylinder head. The cylinder head is provided with a pair of guide arms which are arranged so as to interpose therebetween the cam follower. The guide arms have on the inboard sides thereof guiding faces respectively matched with the sliding faces of the cam follower in such a manner that a clearance is provided between the matched sliding and guiding faces. By setting the clearance in such a manner as to satisfy a certain relation, the sliding and guiding faces can be held out of contact with each other during normal operating condition of the engine.

5 Claims, 3 Drawing Sheets

VALVE TRAIN ARRANGEMENT FOR MULTI-VALVE ENGINE

BACKGROUND OF THE INVENTION

1. Field of the invention

The present invention relates in general to a multi-valve internal combustion engine having duplicated or tripricated inlet and/or exhaust valves per each cylinder and more particularly to a valve train arrangement used in such a multi-valve engine and having a cam follower adapted to operate two or three valves (inlet or exhaust) in unison.

2. Description of the Prior Art

In a known valve train arrangement for a multi-valve engine, a single cam follower is adapted to operate two valves in unison with a view to reducing the mass of the valve train movable parts thus enabling high RPM engine operation. The cam follower may be arranged so as to pivot upon a lash adjuster as disclosed in Japanese Provisional Patent Publication No. 59-103907.

In order that the two-fingered cam follower is correctly held in contact with the valve stems, it has been proposed to provide the cam follower with a guide means in the form of flanges as disclosed in co-pending U.S. patent application Ser. No. 900,844, filed Aug. 27, 1986 still pending.

With this guide means, the cam follower however has a possibility of being displaced out of position relative to the valve stems when the engine is over-revved due to an errorneous work on the accelerator pedal or the like. This is because under such an engine over-revved condition the cam follower effects a so-called "jumping" or "bouncing action and moves apart from the valve stems by the amount exceeding the height of the flanges, resulting in that the cam follower is movable freely relative to the valve stems, i.e., movable upwardly and downwardly and tiltable laterally while pivoting upon the lash adjuster. When the cam follower is out of position, e.g., when the cam follower is put into a condition in which the guide means is clamped between the cam follower and the valve stems or the cam follower is disengaged from the valve stems, the valve train will be damaged and malfunction.

SUMMARY OF THE INVENTION

In accordance with the present invention, there is provided a novel and improved valve train arrangement for a multi-valve internal combustion engine. The valve train arrangement comprises a pair of guide arms provided to a cylinder head in such a manner as to interpose therebetween a cam follower. The cam follower has on opposite sides thereof sliding faces. The guide arms have guiding faces respectively matched with the sliding faces in such a manner that a clearance (W) is provided between each of matched pairs of the guiding faces and the sliding faces.

In one embodiment, the cam follower has two fingers provided with integral flanges which depend down on the inboard sides of valve stems. A clearance ($C_1$) is provided between each of matched pairs of the flanges and the valve stems. The flanges each have a chamferred end of which guiding edge remotest from corresponding one of the fingers is arranged so that a clearance ($C_2$) is provided between the guiding edge and corresponding one of the valve stems. The clearance ($C_1$), ($C_2$) and (W) are set so as to satify the relation $C_2 > W > C_1$.

The above structure is quite effective for overcoming the above noted disadvantage inherent in the prior art device.

It is accordingly an object of the present invention to provide a novel and improved valve train arrangement for a multi-valve internal combustion engine which is assuredly prevented from being damaged and malfunctioning even when the engine is over-revved.

It is a further object of the present invention to provide a novel and improved valve train arrangement of the above described character which can assuredly prevent a cam follower from tilting or moving sideways relative to the valve stems even when the cam follower effects a so-called "jumping" or "bouncing" action and moves apart from the valve stems by the amount exceeding beyond the height of the flanges provided to the cam follower for location of same.

DESCRIPTION OF THE PREFERRED EMBODIMENTS

Figure 1:
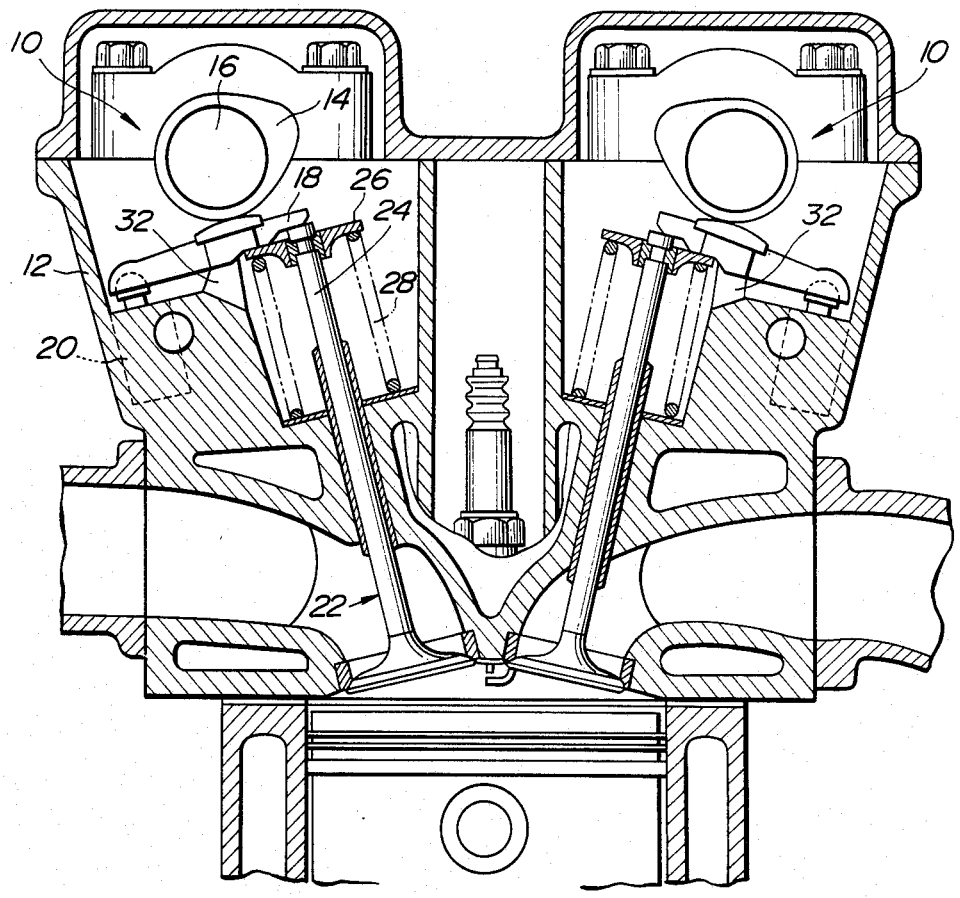
FIG. 1 is a sectional view of a multi-valve engine in which a valve train arrangement according to an embodiment of the present invention is incorporated.

Referring to FIGS. 1 to 5, a valve train arrangement of this invention is generally indicated by numeral 10 and shown as comprising a cylinder head 12, a cam 14 rotatable with a cam shaft 16 which is in turn rotatably interlocked with the crankshaft of the engine, a Y-shaped or V-shaped cam follower 18, a hydraulic valve lifter or lash adjuster 20, and two inlet or exhaust valves 22 in the form of a poppet valve and having valve stems 24. Indicated by numeral 26 is a valve spring retainer, and by 28 is a valve spring.

The cam follower 18 is pivotally mounted at an end **18*a* on the lash adjuster 20. The lash adjuster 20 is of the well known type and is provided with a spherically convexed or domed end 20*a* which is received in a corresponding spherically concave recess formed in the end 18*a* of the cam follower 18. The other end of the cam follower 18 is bifurcated to have two fingers 18*b*, 18*b* which are brought into contact with the terminal ends of the valve stems 24, 24**, respectively.

The cam follower 18 is adapted to engage on the first side, i.e., on the lower side thereof with the lash adjuster 20 and the valves 22, 22 and on the second side opposite to the first side, i.e., on the upper side and at a location intermediate between the above described opposite ends with the cam 14 so that as the cam shaft 16 rotates the cam follower 18 swings about the lash adjuster 20 toward and away from the valves 22, 22 thus driving the same to reciprocate correspondingly.

The cam follower 18 has on the sides opposing in the direction crossing at right angles the direction in which the first and second sides are opposed, i.e., on the horizontally opposed left-hand and right-hand sides thereof smoothly finished, planar sliding faces 30, 30 which are arranged in parallel with the plane "P" of swinging of the cam follower 18, i.e., the plane "P" in which the cam follower 18 swings being driven by the cam 14.

The cylinder head 12 has a pair of integral guide arms 32, 32 which are arranged so as to interpose therebetween the cam follower 18. More specifically, the guide arms 32, 32 has on the inboard sides thereof guiding faces 34, 34, respectively. The guiding faces 34, 34 are arranged so as to be respectively matched with the sliding faces 30, 30 of the cam follower 18 in such a manner that a clearance "W" is provided between the matched guiding and sliding faces 30, 34.

The fingers **18*b*, 18*b* of the cam follower 18 are respectively provided with integral flanges 36, 36 which depend down on the inboard sides of the valve stems 24, 24. The flanges 36, 36 limit lateral movement of the cam follower 18 relative to the valve stems 24, 24 so that the cam follower 18 is held in place relative to the valve stems 24, 24**.

A clearance "$C_1$" is provided between the flange 36 and the valve stem 24. The flange 36 has a chamferred end of which guiding edge remotest from the finger **18*b* is arranged so that a clearance "$C_2$" is provided between the guiding edge of the flange 36 and the valve stem 24** matched therewith. The clearances "$C_1$" and "$C_2$" are set in respect to the clearance "W" in such a way as to satisfy the relation $C_2 > W > C_1$.

By designing the valve train in such a way as to satisfy the above relation, the matched sliding and guiding faces 30, 34 can be held out of contact under normal operating condition of the engine, i.e., when the engine is operated at a speed lower than a predetermined maximum RPM, thus preventing the matched sliding and guiding faces 30, 34, from producing noise and friction.

Figure 2:
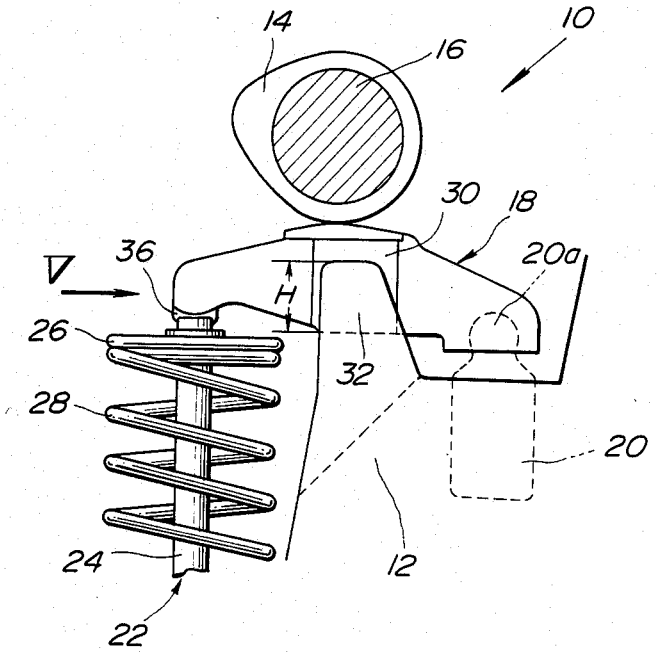
FIG. 2 is an enlarged elevational view of the valve train arrangement of FIG. 1.
Figure 3:
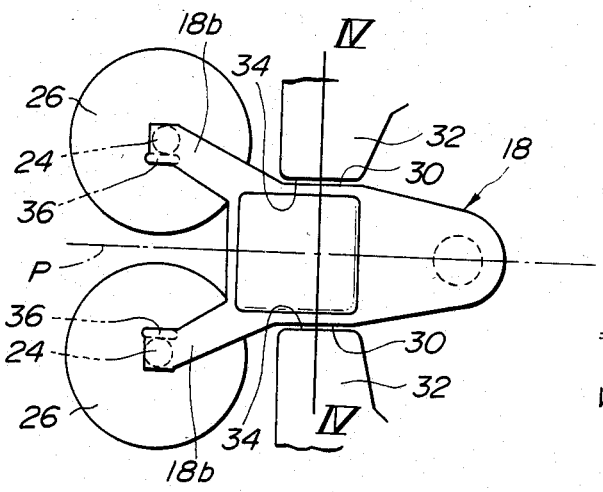
FIG. 3 is an enlarged top plan view of the valve train arrangement of FIG. 1.

The guiding faces 34, 34 of the guide arms, 32, 32 are adapted to lap over the sliding faces 30, 30 of the cam follower 18 by the length "H" when viewed in the elevational view of FIG. 2 and when the cam follower 18 is held in contact with the base circle portion of the cam 14. The length "H" is set in view of the extent of swinging of the cam follower 18.

In operation, rotation of the cam shaft 16 causes the cam follower 18 to swing about the lash adjuster 20 being driven by the cam 14. During normal operation of the engine, the cam follower 18 swings in the plane "P" while transmitting through the fingers **18*b*, 18*b* the motion of the cam 14 to the terminal ends of the valve stems 24, 24. In this instance, due to the provision of the clearance "W", the sliding faces 30, 30 of the cam follower 18 are held out of contact with the guiding faces 34, 34 of the guide arms 32, 32**, thus preventing production of noise and friction.

During abnormal operating condition of the engine, i.e., when the engine is over-revved due to a certain errorneous work on the accelerator pedal or the like, the valves 22, 22 may effect a so-called "jumping" or "bouncing" action to allow the fingers **18*b*, 18*b* to move away from the terminal ends of the valve stems 24, 24 by the amount exceeding the height of the flanges 36, 36. In this instance, the sliding faces 30, 30 of the cam follower 18 come in contact with the guiding faces 34, 34 of the guide arms 32, 32 so that movement of the cam follower 18 is guided by the guide arms 32, 32, thus preventing the cam follower 18 from being displaced out of position relative to the cam 14 and the valves 22, 22, e.g., preventing the flanges 36, 36 from being clamped between the fingers 18*b*, 18*b* of the cam follower 18 and the terminal ends of the valve stems 24, 24**. The valve train arrangement of this invention is therefore assuredly prevented from being damaged and malfunctioning even when the engine is over-revved.

When RPM of the engine lowers below a predetermined maximum value, the valve train returns to its normal operating condition and enables the cam follower 18 to accurately transmit the motion of the cam 14 to the valves 22, 22.

Figure 4:
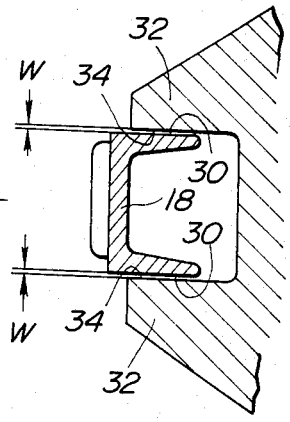
FIG. 4 is a sectional view taken along the line IV—IV of FIG. 3.
Figure 5:
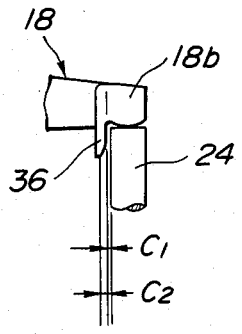
FIG. 5 is a view taken in the direction of the arrow "V" of FIG. 2.

The cam follower 18 has, as shown in FIG. 4, a channel-shaped sectional portion to which the sliding portions 30, 30 are provided. This is advantageous from the point of view of light weight and simple structure. The cam follower 18 can be produced by forging or the like without increasing the weight as compared with the comparable prior art cam follower.

Figure 6:
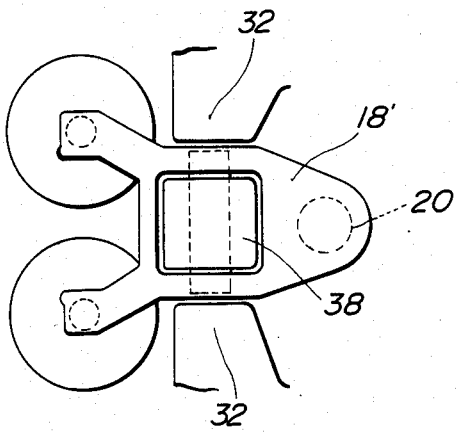
FIG. 6 is a top plan view similalr to FIG. 3 but showing a modificlation of the present invention.

Referring to FIG. 6, this embodiment differs from the previous embodiment in that the cam follower 18' is provided with a roller 38 at a portion for contact with the cam 14. By the provision of the roller 38, the friction between the cam 14 and the cam follower 18' can be reduced considerably, thus improving the fuel consumption and the output of the engine.

While the guide arms has been described and shown as being integral with the cylinder head so as to be made of an aluminium alloy and produced by casting at the time of casting of the cylinder head, they are not limited to be so. For example, the guide arms can be independent parts which are bolted or otherwise secured to the cylinder head.

What is claimed is:

1. A valve train arrangement for a multi-valve internal combustion engine, comprising: a cylinder head;

pivot means mounted on said cylinder head;

two valve stems;

a cam for operating said valve stems;

a cam follower pivotally mounted at one end on said pivot means and having at the other end two fingers operatively engaged with said cam for transmitting motion of said cam to said valve stems;

a pair of guide arms provided to said cylinder head in such a manner as to interpose therebetween said cam follower;

said cam follower having on opposite sides thereof sliding faces;

said guide arms having guiding faces respectively matched with said sliding faces in such a manner that a clearance (W) is provided between each of matched pairs of said guiding faces and said sliding faces;

said fingers of said cam follower being provided with integral flanges which depend downwardly on the inboard sides of said valve stems; and a clearance ($C_1$) being defined between matched pairs of said flanges and said valve stems, said flanges each having a chamferred end of which a guiding edge most remote from a corresponding one of said fingers is arranged so that a clearance ($C_2$) is provided between said guiding edge and a corresponding one of said valve stems, said clearances ($C_1$), ($C_2$) and (W) being set so as to satisfy the relationship $C_2 > W > C_1$.

2. A valve train arrangement as set forth in claim 1 wherein said sliding faces of said cam follower are arranged so as to be parallel with a plane in which said cam follower swings being driven by said cam.

3. A valve train arrangement as set forth in claim 1 wherein said pivot means comprises a hydraulic lash adjuster.

4. A valve train arrangement as set forth in claim 1 wherein said guide arms are integral with said cylinder head.

5. A valve train arrangement as set forth in claim 1 wherein said cam follower is provided with a roller for contact with said cam.

* * * * *